US011112175B2

(12) United States Patent
Mak

(10) Patent No.: US 11,112,175 B2
(45) Date of Patent: Sep. 7, 2021

(54) PHASE IMPLEMENTATION OF NATURAL GAS LIQUID RECOVERY PLANTS

(71) Applicant: Fluor Technologies Corporation, Sugar Land, TX (US)

(72) Inventor: John Mak, Santa Ana, CA (US)

(73) Assignee: Fluor Technologies Corporation, Irving, TX (US)

( * ) Notice: Subject to any disclaimer, the term of this patent is extended or adjusted under 35 U.S.C. 154(b) by 358 days.

(21) Appl. No.: 15/789,463

(22) Filed: Oct. 20, 2017

(65) Prior Publication Data

US 2019/0120550 A1 Apr. 25, 2019

(51) Int. Cl.
*F25J 3/02* (2006.01)

(52) U.S. Cl.
CPC ..... *F25J 3/0238* (2013.01); *F25J 3/0209* (2013.01); *F25J 3/0233* (2013.01); *F25J 3/0242* (2013.01); *F25J 2200/04* (2013.01); *F25J 2200/70* (2013.01); *F25J 2200/78* (2013.01); *F25J 2205/04* (2013.01); *F25J 2205/50* (2013.01); *F25J 2210/06* (2013.01); *F25J 2215/04* (2013.01); *F25J 2215/62* (2013.01);

(Continued)

(58) Field of Classification Search
CPC ..... F25J 3/0233; F25J 3/0238; F25J 3/0242; F25J 3/0209; F25J 2200/04; F25J 2215/62; F25J 2215/64; C07C 7/04
See application file for complete search history.

(56) References Cited

U.S. PATENT DOCUMENTS 2,603,310 A 7/1952 Gilmore et al.
2,771,149 A 11/1956 Miller et al.
(Continued)

FOREIGN PATENT DOCUMENTS

AR 103703 5/2017
AT 383557 T 1/2008
(Continued)

OTHER PUBLICATIONS

European Patent Application No. 16884122.9, Communication pursuant to Rules 161 and 162 EPC, dated Aug. 20, 2018, 3 pages.
(Continued)

*Primary Examiner* — John F Pettitt, III
(74) *Attorney, Agent, or Firm* — Conley Rose, PC

(57) ABSTRACT

Embodiments relate generally to systems and methods for operating a natural gas liquids plant in ethane rejection and in ethane recovery. A natural gas liquid plant may comprise an absorber configured to produce an ethane rich bottom stream and an ethane depleted vapor stream; a stripper fluidly coupled to the absorber configured to, during ethane rejection, fractionate the ethane rich bottom stream from the absorber into an ethane overhead product and a propane plus hydrocarbons product, and configured to, during ethane recovery, fractionate the ethane rich bottom stream into an ethane plus NGL stream and an overhead vapor stream; and an exchanger configured to, during ethane recovery, countercurrently contact the ethane rich bottom stream from the absorber with the ethane depleted vapor stream from the absorber, thereby heating the vapor stream and chilling the ethane rich bottom stream before the ethane rich bottom stream is fed to the stripper.

15 Claims, 4 Drawing Sheets

(52) U.S. Cl.
CPC ..... *F25J 2215/64* (2013.01); *F25J 2240/02* (2013.01); *F25J 2240/40* (2013.01); *F25J 2270/02* (2013.01); *F25J 2270/08* (2013.01); *F25J 2270/12* (2013.01); *F25J 2270/60* (2013.01); *F25J 2280/02* (2013.01)

(56) References Cited

U.S. PATENT DOCUMENTS 3,320,754 A 5/1967 Tucker et al.
3,421,610 A 1/1969 Marshall et al.
3,793,157 A 2/1974 Hobbs et al.
4,004,430 A 1/1977 Solomon et al.
4,061,481 A 12/1977 Campbell et al.
4,102,659 A 7/1978 Martin
4,157,904 A 6/1979 Campbell et al.
4,164,452 A 8/1979 Funk et al.
4,203,742 A 5/1980 Agnihotri
4,453,958 A 6/1984 Gulsby et al.
4,496,380 A 1/1985 Harryman
4,507,133 A 3/1985 Khan et al.
4,519,824 A 5/1985 Huebel
4,617,039 A 10/1986 Buck
4,676,812 A 6/1987 Kummann
4,695,349 A 9/1987 Becker et al.
4,895,584 A * 1/1990 Buck ..... F25J 3/0219 62/621
5,291,736 A 3/1994 Paradowski et al.
5,462,583 A 10/1995 Wood et al.
5,555,748 A 9/1996 Campbell et al.
5,657,643 A 8/1997 Price
5,669,238 A 9/1997 Devers
5,687,584 A 11/1997 Mehra
5,746,066 A 5/1998 Manley
5,881,569 A 3/1999 Campbell et al.
5,983,664 A 11/1999 Campbell et al.
5,992,175 A 11/1999 Yao et al.
6,006,546 A 12/1999 Espie
6,112,549 A 9/2000 Yao et al.
6,116,051 A 9/2000 Agrawal et al.
6,125,653 A 10/2000 Shu et al.
6,308,532 B1 10/2001 Hopewell
6,311,516 B1 11/2001 Key et al.
6,336,344 B1 1/2002 O'Brien
6,354,105 B1 3/2002 Lee et al.
6,363,744 B2 4/2002 Finn et al.
6,405,561 B1 6/2002 Mortko et al.
6,453,698 B2 9/2002 Jain et al.
6,516,631 B1 2/2003 Trebble
6,601,406 B1 8/2003 Deng et al.
6,658,893 B1 12/2003 Mealey
6,755,965 B2 6/2004 Pironti et al.
6,823,692 B1 11/2004 Patel et al.
6,837,070 B2 1/2005 Mak
6,915,662 B2 7/2005 Wilkinson et al.
7,051,552 B2 5/2006 Mak
7,069,744 B2 7/2006 Patel et al.
7,073,350 B2 7/2006 Mak
7,107,788 B2 9/2006 Patel et al.
7,159,417 B2 1/2007 Foglietta et al.
7,192,468 B2 3/2007 Mak et al.
7,377,127 B2 5/2008 Mak
7,424,808 B2 9/2008 Mak
7,437,891 B2 10/2008 Reyneke et al.
7,574,856 B2 8/2009 Mak
7,597,746 B2 10/2009 Mak et al.
7,600,396 B2 10/2009 Mak
7,635,408 B2 12/2009 Mak et al.
7,637,987 B2 12/2009 Mak
7,674,444 B2 3/2010 Mak
7,713,497 B2 5/2010 Mak
7,856,847 B2 12/2010 Patel et al.
7,856,848 B2 12/2010 Lu
8,110,023 B2 2/2012 Mak et al.
8,117,852 B2 2/2012 Mak
8,142,648 B2 3/2012 Mak
8,147,787 B2 4/2012 Mak et al.
8,192,588 B2 6/2012 Mak
8,196,413 B2 6/2012 Mak
8,209,996 B2 7/2012 Mak
8,316,665 B2 11/2012 Mak
8,377,403 B2 2/2013 Mak
8,398,748 B2 3/2013 Mak
8,434,325 B2 5/2013 Martinez et al.
8,480,982 B2 7/2013 Mak et al.
8,505,312 B2 8/2013 Mak et al.
8,528,361 B2 9/2013 Nanda et al.
8,567,213 B2 10/2013 Mak
8,635,885 B2 1/2014 Mak
8,661,820 B2 3/2014 Mak
8,677,780 B2 3/2014 Mak
8,695,376 B2 4/2014 Mak
8,696,798 B2 4/2014 Mak
8,840,707 B2 9/2014 Mak
8,845,788 B2 9/2014 Mak
8,850,849 B2 10/2014 Martinez et al.
8,876,951 B2 11/2014 Mak
8,893,515 B2 11/2014 Mak
8,910,495 B2 12/2014 Mak
8,919,148 B2 12/2014 Wilkinson et al.
8,950,196 B2 2/2015 Mak
9,114,351 B2 8/2015 Mak
9,132,379 B2 9/2015 Mak
9,248,398 B2 2/2016 Mak
9,423,175 B2 8/2016 Mak
9,557,103 B2 1/2017 Mak
9,631,864 B2 4/2017 Chen et al.
10,006,701 B2 6/2018 Mak
10,077,938 B2 9/2018 Mak
10,330,382 B2 6/2019 Mak et al.
10,451,344 B2 10/2019 Mak
10,704,832 B2 7/2020 Mak
10,760,851 B2 9/2020 Thiebault et al.
2002/0042550 A1 4/2002 Pironti et al.
2002/0157538 A1 10/2002 Foglietta et al.
2003/0005722 A1 1/2003 Wilkinson et al.
2004/0079107 A1 4/2004 Wilkinson et al.
2004/0206112 A1 10/2004 Mak
2004/0237580 A1 12/2004 Mak
2004/0250569 A1 12/2004 Mak
2005/0047995 A1 3/2005 Wylie
2005/0218041 A1 10/2005 Yoshida et al.
2005/0255012 A1 11/2005 Mak
2006/0000234 A1 1/2006 Cuellar et al.
2006/0021379 A1 2/2006 Ronczy
2006/0221379 A1 10/2006 Noda
2006/0260355 A1 11/2006 Roberts et al.
2006/0277943 A1 12/2006 Yokohata et al.
2007/0157663 A1 7/2007 Mak et al.
2007/0240450 A1 10/2007 Mak
2008/0016909 A1 1/2008 Lu
2009/0100862 A1 4/2009 Wilkinson et al.
2009/0113931 A1 5/2009 Patel et al.
2009/0277217 A1 11/2009 Ransbarger et al.
2010/0000255 A1 1/2010 Mak
2010/0011809 A1 1/2010 Mak
2010/0011810 A1 1/2010 Mak et al.
2010/0043488 A1 2/2010 Mak et al.
2010/0126187 A1 5/2010 Mak
2010/0275647 A1 11/2010 Johnke et al.
2010/0287984 A1 11/2010 Johnke et al.
2011/0067442 A1 3/2011 Martinez et al.
2011/0174017 A1 7/2011 Victory et al.
2011/0265511 A1 11/2011 Fischer et al.
2012/0000245 A1 1/2012 Currence et al.
2012/0036890 A1 2/2012 Kimble et al.
2012/0085127 A1 4/2012 Nanda et al.
2012/0096896 A1 4/2012 Patel et al.
2012/0137726 A1 6/2012 Currence et al.
2013/0061632 A1 3/2013 Brostow et al.
2013/0061633 A1 3/2013 Mak et al.
2013/0186133 A1 7/2013 Ploeger et al.
2013/0298602 A1 11/2013 Prim
2014/0013797 A1 1/2014 Butts
2014/0026615 A1 1/2014 Mak

(56) References Cited

U.S. PATENT DOCUMENTS

| | | | |
|---|---|---|---|
| 2014/0075987 | A1 | 3/2014 | Mak |
| 2014/0182331 | A1 | 7/2014 | Burmberger et al. |
| 2014/0260420 | A1 | 9/2014 | Mak |
| 2014/0290307 | A1 | 10/2014 | Gahier et al. |
| 2015/0184931 | A1 | 7/2015 | Mak |
| 2015/0322350 | A1 | 11/2015 | Iyer et al. |
| 2016/0069610 | A1 | 3/2016 | Ascencion et al. |
| 2016/0231052 | A1 | 8/2016 | Mak |
| 2016/0327336 | A1 | 11/2016 | Kennedy et al. |
| 2017/0051970 | A1 | 2/2017 | Mak |
| 2017/0058708 | A1 | 3/2017 | Noureldin et al. |
| 2017/0336137 | A1 | 11/2017 | Mak et al. |
| 2017/0370641 | A1 | 12/2017 | Mak et al. |
| 2018/0017319 | A1 | 1/2018 | Mak et al. |
| 2018/0058754 | A1 | 3/2018 | Lynch et al. |
| 2018/0066889 | A1 | 3/2018 | Gaskin et al. |
| 2018/0149425 | A1 | 5/2018 | Oneal et al. |
| 2018/0231305 | A1 | 8/2018 | Pierre, Jr. |
| 2018/0266760 | A1 | 9/2018 | Mak et al. |
| 2018/0306498 | A1 | 10/2018 | Rovers et al. |
| 2018/0320960 | A1 | 11/2018 | Terrien et al. |
| 2018/0347899 | A1 | 12/2018 | Cuellar et al. |
| 2019/0011180 | A1 | 1/2019 | Mostafa |
| 2019/0086147 | A1 | 3/2019 | Brown, III et al. |
| 2019/0154333 | A1 | 5/2019 | Mak |
| 2019/0242645 | A1 | 8/2019 | Mak et al. |
| 2020/0064064 | A1 | 2/2020 | Butts |
| 2020/0072546 | A1 | 3/2020 | Thorn et al. |
| 2020/0141639 | A1 | 5/2020 | Mak |
| 2020/0191477 | A1 | 6/2020 | Mak |
| 2020/0199046 | A1 | 8/2020 | Simon et al. |
| 2020/0370824 | A1 | 11/2020 | Mak et al. |

FOREIGN PATENT DOCUMENTS

| | | | |
|---|---|---|---|
| AU | 2002303849 | B2 | 5/2006 |
| AU | 2008287322 | B2 | 4/2012 |
| AU | 2011349713 | A1 | 7/2013 |
| CA | 2484085 | C | 8/2008 |
| CA | 2694149 | A1 | 2/2009 |
| CA | 2976071 | | 8/2017 |
| CA | 289132 | C | 9/2020 |
| CA | 2976071 | C | 10/2020 |
| CN | 101815915 | B | 4/2014 |
| DE | 60224585 | T2 | 4/2009 |
| EA | 007771 | B1 | 2/2007 |
| EA | 201390957 | A1 | 12/2013 |
| EP | 0010939 | A1 | 5/1980 |
| EP | 1508010 | B1 | 1/2008 |
| EP | 2185878 | A1 | 5/2010 |
| EP | 2521761 | A1 | 11/2012 |
| EP | 2655992 | A1 | 10/2013 |
| EP | 3256550 | A1 | 12/2017 |
| GC | 0004114 | | 4/2016 |
| JP | 2007510124 | A | 4/2007 |
| MX | PA04011219 | A | 2/2005 |
| MX | 2010001472 | A | 3/2010 |
| MX | 2013007136 | A | 8/2013 |
| WO | WO99023428 | A1 | 5/1999 |
| WO | 0188447 | A1 | 11/2001 |
| WO | 0214763 | A1 | 2/2002 |
| WO | WO2003095913 | A1 | 11/2003 |
| WO | WO2004017002 | A1 | 2/2004 |
| WO | WO2004076946 | A2 | 9/2004 |
| WO | 20044580 | A | 12/2004 |
| WO | WO2005045338 | A1 | 5/2005 |
| WO | WO2008002592 | A2 | 1/2008 |
| WO | 2011123278 | A1 | 10/2011 |
| WO | WO2012087740 | A1 | 6/2012 |
| WO | WO2012177749 | A2 | 12/2012 |
| WO | WO2014047464 | A1 | 3/2014 |
| WO | WO2014151908 | A1 | 9/2014 |
| WO | WO2016130574 | A1 | 8/2016 |
| WO | WO2017119913 | A1 | 7/2017 |
| WO | WO2017200557 | A1 | 11/2017 |
| WO | 2018049128 | A1 | 3/2018 |
| WO | 2019078892 | A1 | 4/2019 |
| WO | 2019226156 | A1 | 11/2019 |

OTHER PUBLICATIONS

Office Action dated Mar. 1, 2019, U.S. Appl. No. 15/259,354, filed Sep. 8, 2016.

Notice of Allowance dated Jan. 24, 2019, U.S. Appl. No. 15/158,143, filed May 16, 2016.

Final Office Action dated Mar. 6, 2019, U.S. Appl. No. 15/191,251, filed Jun. 23, 2016.

International Search Report and Written Opinion, dated Dec. 12, 2017, PCT/US2017/0050636, filed on Sep. 8, 2017.

International Preliminary Report on Patentability, dated Nov. 29, 2018, PCT/US2016/034362, filed on May 26, 2016.

Area 4, "Reboilers", found at: https://www.area4.info/Area4%20Informations/REBOILERS.htm.

Mak, John, "Configurations and Methods for NGL Recovery for High Nitrogen Content Feed Gases," filed Jan. 29, 2019, U.S. Appl. No. 16/260,288.

Mak, John et al., "Methods and Configuration for Retrofitting NGL Plant for High Ethane Recovery." filed Sep. 9, 2016, U.S. Appl. No. 62/385,748.

Mak, John et al., "Methods and Configuration for Retrofitting NGL Plant for High Ethane Recovery." filed Feb. 14, 2019, U.S. Appl. No. 15/325,696.

Foreign Communication from a Related Counterpart—International Search Report and Written Opinion, dated Jul. 21, 2013, PCT/US2012/043332, filed Jun. 20, 2012.

Foreign Communication from a Related Counterpart—International Preliminary Report on Patentability, dated Jan. 1, 2015, PCT/US2012/043332, filed Jun. 20, 2012.

Foreign Communication from a Related Counterpart—International Search Report and Written Opinion, dated Jan. 14, 2014, PCT/US2013/060971, filed Sep. 20, 2013.

Foreign Communication from a Related Counterpart—International Preliminary Report on Patentability, dated Jan. 7, 2015, PCT/US2013/060971, filed Sep. 20, 2013.

Foreign Communication from a Related Counterpart—International Search Report and Written Opinion, dated Jul. 1, 2016, PCT/US2016/017190, filed Feb. 6, 2016.

Foreign Communication from a Related Counterpart—International Preliminary Report on Patentability, dated Aug. 24, 2017, PCT/US2016/017190, filed Feb. 6, 2016.

Foreign Communication from a Related Counterpart—International Search Report and Written Opinion, dated Jul. 7, 2014, PCT/US2014/026655, filed on Mar. 14, 2014.

Foreign Communication from a Related Counterpart—International Preliminary Report on Patentability, dated Sep. 15, 2015, PCT/US2014/026655, filed on Mar. 14, 2014.

Foreign Communication from a Related Counterpart—International Search Report and Written Opinion, dated Dec. 8, 2016, PCT/US2016/034362, filed on May 26, 2016.

Foreign Communication from a Related Counterpart—International Search Report and Written Opinion, dated May 1, 2018, PCT/US2017/057674, filed on Oct. 20, 2017.

Foreign Communication from a Related Counterpart—International Search Report and Written Opinion, dated Jul. 23, 2018, PCT/US2018/033875, filed on May 22, 2018.

Mak, John, "Ethane Recovery or Ethane Rejection Operation," filed May 24, 2018, U.S. Appl. No. 15/988,310.

Mak, John, "Flexible NGL Recovery and Methods," filed Oct. 20, 2003, U.S. Appl. No. 60/516,120.

Mak, John, "Ethane Recovery and Ethane Rejection Methods and Configurations," filed Dec. 23, 2010, U.S. Appl. No. 61/426,756.

Mak, John, "Ethane Recovery and Ethane Rejection Methods and Configurations," filed Jan. 21, 2011, U.S. Appl. No. 61/434,887.

Mak, John, "Configurations and Methods for Retrofitting NGL Recovery Plant," filed Jun. 20, 2011, U.S. Appl. No. 61/499,033.

(56) References Cited

OTHER PUBLICATIONS

Mak, John, "Configurations and Methods for NGL Recovery for High Nitrogen Content Feed Gases," filed Sep. 20, 2012, U.S. Appl. No. 61/703,654.
Mak, John, "Flexible NGL Recovery Methods and Configurations," filed Mar. 14, 2013, U.S. Appl. No. 61/785,329.
Mak, John, "Methods and Configuration of an NGL Recovery Process for Low Pressure Rich Feed Gas," filed Feb. 9, 2015, U.S. Appl. No. 62/113,938.
Mak, John, "Phase Implementation of Natural Gas Liquid Recovery Plants," filed Oct. 20, 2017, International Application No. PCT/US2017/057674.
Mak, John, et al., "Integrated Methods and Configurations for Ethane Rejection and Ethane Recovery," filed May 22, 2018, Application No. PCT/US2018/033875.
Restriction Requirement dated Sep. 12, 2018, U.S. Appl. No. 15/259,354, filed Sep. 8, 2016.
Notice of Allowance dated Oct. 18, 2018, MX Application No. MX/A/2013/014864, filed on Dec. 13, 2013.
Final Office Action dated Oct. 17, 2018, U.S. Appl. No. 14/033,096, filed Sep. 20, 2013.
Office Action dated Oct. 4, 2018, U.S. Appl. No. 15/158,143, filed May 16, 2016.
Office Action dated Aug. 11, 2017, U.S. Appl. No. 15/191,251, filed Jun. 23, 2016.
Final Office Action dated Feb. 1, 2018, U.S. Appl. No. 15/191,251, filed Jun. 23, 2016.
Advisory Action dated Apr. 23, 2018, U.S. Appl. No. 15/191,251, filed Jun. 23, 2016.
Office Action dated Aug. 15, 2018, U.S. Appl. No. 15/191,251, filed Jun. 23, 2016.
Restriction Requirement dated May 12, 2017, U.S. Appl. No. 14/988,388, filed Jan. 5, 2016.
Office Action dated Aug. 10, 2017, U.S. Appl. No. 14/988,388, filed Jan. 5, 2016.
Final Office Action dated Nov. 29, 2017, U.S. Appl. No. 14/988,388, filed Jan. 5, 2016.
Notice of Allowance dated Feb. 16, 2018, U.S. Appl. No. 14/988,388, filed Jan. 5, 2016.
First Office Action dated Dec. 14, 2007, CN Application No. 200480039552.8 filed Oct. 30, 2003.
Second Office Action dated Nov. 7, 2008, CN Application No. 200480039552.8 filed Oct. 30, 2003.
Notice of Decision to Grant dated Jul. 31, 2009, CN Application No. 200480039552.8 filed Oct. 30, 2003.
Examination Report dated Dec. 19, 2012, EP Application No. 04794213.1 filed Oct. 4, 2004.
Second Examination Report dated Oct. 7, 2014, EP Application No. 04794213.1, filed Oct. 4, 2004.
Office Action dated Jan. 7, 2009, JP Application No. 2006538016, priority date Oct. 30, 2003.
Decision to Grant dated Aug. 20, 2010, JP Application No. 2006538016, priority date Oct. 30, 2003.
Office Action dated Aug. 4, 2010, U.S. Appl. No. 10/595,528, filed Feb. 28, 2007.
Final Office Action dated Dec. 29, 2010, U.S. Appl. No. 10/595,528, filed Feb. 28, 2007.
Advisory Action dated Apr. 14, 2011, U.S. Appl. No. 10/595,528, filed Feb. 28, 2007.
Office Action dated Jun. 8, 2011, U.S. Appl. No. 10/595,528, filed Feb. 28, 2007.
Final Office Action dated Oct. 27, 2011, U.S. Appl. No. 10/595,528, filed Feb. 28, 2007.
Notice of Allowance dated Mar. 5, 2012, U.S. Appl. No. 10/595,528, filed Feb. 28, 2007.
Restriction Requirement dated Sep. 22, 2015, U.S. Appl. No. 13/996,805, filed Sep. 17, 2013.
Office Action dated Feb. 9, 2016, U.S. Appl. No. 13/996,805, filed Sep. 17, 2013.
Notice of Allowance dated Jun. 9, 2016, U.S. Appl. No. 13/996,805, filed Sep. 17, 2013.
Australian Application No. 2011349713, Examination Report, dated Dec. 16, 2014, 2 pages.
Australia Application No. 2011349713, Notice of Acceptance, dated Mar. 31, 2015, 2 pages.
Restriction Requirement dated Jan. 8, 2014, U.S. Appl. No. 13/528,332, filed Jun. 20, 2012.
Notice of Allowance dated Aug. 15, 2014, U.S. Appl. No. 13/528,332, filed Jun. 20, 2012.
Examination Report dated Mar. 17, 2016, AU Application No. 2012273028, priority date Jun. 20, 2011.
Office Action dated Jun. 28, 2018, CA Application No. 2,839,132, filed on Dec. 11, 2013.
Office Action dated Jun. 29, 2018, MX Application No. MX/A/2013/014864, filed on Dec. 13, 2013.
Restriction Requirement dated Nov. 19, 2015, U.S. Appl. No. 14/033,096, filed Sep. 20, 2013.
Office Action dated Jun. 2, 2016, U.S. Appl. No. 14/033,096, filed Sep. 20, 2013.
Final Office Action dated Dec. 9, 2016, U.S. Appl. No. 14/033,096, filed Sep. 20, 2013.
Advisory Action dated Feb. 28, 2017, U.S. Appl. No. 14/033,096, filed Sep. 20, 2013.
Office Action dated May 11, 2017, U.S. Appl. No. 14/033,096, filed Sep. 20, 2013.
Final Office Action dated Nov. 15, 2017, U.S. Appl. No. 14/033,096, filed Sep. 20, 2013.
Advisory Action dated Feb. 6, 2018, U.S. Appl. No. 14/033,096, filed Sep. 20, 2013.
Office Action dated Mar. 26, 2018, U.S. Appl. No. 14/033,096, filed Sep. 20, 2013.
Office Action dated Nov. 25, 2015, U.S. Appl. No. 14/210,061, filed Mar. 14, 2014.
Notice of Allowance dated Mar. 26, 2016, U.S. Appl. No. 14/210,061, filed Mar. 14, 2014.
Office Action dated Sep. 26, 2017, U.S. Appl. No. 15/019,5708, filed Feb. 6, 2016.
Notice of Allowance dated May 18, 2018, U.S. Appl. No. 15/019,5708, filed Feb. 6, 2016.
Office Action dated Jul. 7, 2017, U.S. Appl. No. 15/158,143, filed May 16, 2016.
Final Office Action dated Nov. 1, 2017, U.S. Appl. No. 15/158,143, filed May 16, 2016.
Office Action dated Mar. 14, 2018, U.S. Appl. No. 15/158,143, filed May 16, 2016.
Final Office Action dated Jun. 29, 2018, U.S. Appl. No. 15/158,143, filed May 16, 2016.
Foreign Communication from a Related Counterpart—International Search Report and Written Opinion, dated Aug. 24, 2016, PCT/US2016/013687 , filed on Jan. 15, 2016.
Foreign Communication from a Related Counterpart—International Preliminary Examination Report, dated Jul. 19, 2018, PCT/US2016/013687 , filed on Jan. 15, 2016.
Foreign Communication from a Related Counterpart—International Search Report and Written Opinion, dated Feb. 16, 2005, PCT/US2004/032788, filed on Oct. 5, 2004.
Foreign Communication from a Related Counterpart—International Preliminary Report on Patentability, dated Feb. 27, 2006, PCT/US2004/032788, filed on Oct. 5, 2004.
Foreign Communication from a Related Counterpart—International Search Report and Written Opinion, dated Apr. 18, 2012, PCT/2011/065140, filed on Dec. 15, 2011.
Foreign Communication from a Related Counterpart—International Preliminary Report on Patentability, dated Jun. 25, 2013, PCT/2011/065140, filed on Dec. 15, 2011.
Notice of Allowance dated Jun. 19, 2019, U.S. Appl. No. 15/259,354, filed Sep. 8, 2016.
Office Action dated Apr. 4, 2019, U.S. Appl. No. 14/033,096, filed Sep. 20, 2013.
Office Action dated Mar. 21, 2019, Canadian Patent Application No. 2976071.

(56) References Cited

OTHER PUBLICATIONS

International Preliminary Report on Patentability, dated Mar. 21, 2019, PCT/US2017/0050636, filed on Sep. 8, 2017.
Mak, John, et al., "Systems and Methods for LNG Production with Propane and Ethane Recovery," filed Apr. 22, 2019, Application No.
China Patent Application No. 200880103754.2, First Office Action, dated Mar. 27, 2012, 20 pages.
China Patent Application No. 200880103754.2, Second Office Action, dated Dec. 26, 2012, 21 pages.
China Patent Application No. 200880103754.2, Third Office Action, dated Jul. 22, 2013, 7 pages.
China Patent Application No. 200880103754.2, Notification to Grant Patent Right for Invention, dated Dec. 23, 2013, 2 pages.
Australia Patent Application No. 2008287322, First Examination Report, dated Apr. 8, 2011, 2 pages.
Europe Patent Application No. 02731911.0, Supplementary European Search Report, dated Nov. 24, 2005, 3 pages.
Europe Patent Application No. 02731911.0, Examination Report, dated Mar. 2, 2006, 5 pages.
Europe Patent Application No. 02731911.0, Examination Report, dated Sep. 19, 2006, 4 pages.
Europe Patent Application No. 02731911.0, Intention to Grant, dated Aug. 1, 2007, 20 pages.
Europe Patent Application No. 02731911.0, Decision to Grant, dated Dec. 13, 2007, 2 pages.
Canada Patent Application No. 2484085, Examination Report, dated Jan. 16, 2007, 3 pages.
Europe Patent Application No. 08795331.1, Communication pursuant to Rules 161 and 162 EPC, dated Mar. 24, 2010, 2 pages.
Australia Patent Application No. 2008287322, Notice of Acceptance, dated Apr. 4, 2012, 1 page.
Canada Patent Application No. 2694149, Office Action, dated Apr. 16, 2012, 2 pages.
Gulf Cooperation Council Patent Application No. GCC/P/2008/11533, Examination Report, dated Dec. 19, 2013, 4 pages.
Mexico Patent Application No. MX/a/2010/001472, Office Action, dated Nov. 15, 2013, 1 page.
Mexico Patent Application No. MX/a/2010/001472, Office Action, dated Jul. 23, 2014, 1 page.
United Arab Emirates Patent Application No. 0143/2010, Search Report, dated Oct. 3, 2015, 9 pages.
Office Action dated Dec. 9, 2019, U.S. Appl. No. 15/988,310, filed May 24, 2018.
Office Action dated Dec. 3, 2019, Canadian Patent Application No. 2976071 filed Feb. 9, 2016.
Extended European Search Report dated Aug. 8, 2019, European Patent Application No. 16884122.9.
Communication Pursuant to Rules 70(2) and 70a(2) EPC dated Aug. 27, 2019, European Patent Application No. 16884122.9.
Corrected Notice of Allowability dated Jul. 2, 2019, U.S. Appl. No. 15/259,354, filed Sep. 8, 2016.
Office Action dated Jun. 14, 2019, Canadian Application No. 2,839,132, filed on Dec. 11, 2013.
Notice of Decision dated Sep. 30, 2019, United Arab Emirates Patent Application No. P1023/2015 filed Mar. 14, 2014.
Extended European Search Report dated Aug. 1, 2018, European Patent Application filed Feb. 9, 2016.
Communication Pursuant to Rules 70(2) and 70a(2) EPC dated Aug. 20, 2018, European Patent Application filed Feb. 9, 2016.
Examination Report dated Jul. 9, 2020, European Patent Application No. 167497733.9 filed Feb. 9, 2016.
International Application No. PCT/US2019/065993 filed Dec. 12, 2019, PCT Search Report and Written Opinion dated Apr. 9, 2020.
Editors: Mokhatab, S.; Poe, W. A. Poe; Spe, J. G. Handbook of Natural Gas Transmission and Processing (Elsevier, 2006, ISBN U 978-0-7506-7776-9, pp. 365-400), Chapter 10, pp. 365-400.
Notice of Allowance dated Mar. 13, 2020, U.S. Appl. No. 15/988,310, filed May 24, 2018.
International Preliminary Report on Patentability, dated Apr. 30, 2020, PCT/US2017/057674, filed on Oct. 20, 2017.
Notice of Allowance dated May 19, 2020, Canadian Patent Application No. 2976071 filed Feb. 9, 2016.
International Preliminary Report on Patentability (Chapter I), completed Jun. 24, 2021, International Application No. PCT/US2019/065993 filed Dec. 12, 2019.
Examination Report dated Apr. 13, 2021, Saudi Arabian Patent Application No. 518391931 filed Jan. 15, 2016.

* cited by examiner

PHASE IMPLEMENTATION OF NATURAL GAS LIQUID RECOVERY PLANTS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Natural gas liquids (NGL) may describe heavier gaseous hydrocarbons: ethane (C2H6), propane (C3H8), normal butane (n-C4H10), isobutane (i-C4H10), pentanes, and even higher molecular weight hydrocarbons, when processed and purified into finished by-products. Systems can be used to recover NGL from a feed gas using natural gas liquids plants.

SUMMARY

In an embodiment, a natural gas liquid plant may be configured to operate in either ethane rejection or ethane recovery and may comprise an absorber configured to produce an ethane rich bottom stream and an ethane depleted vapor stream; a stripper fluidly coupled to the absorber configured to, during ethane rejection, fractionate the ethane rich bottom stream from the absorber into an ethane overhead product and a propane plus hydrocarbons product, and configured to, during ethane recovery, fractionate the ethane rich bottom stream into an ethane plus NGL stream and an overhead vapor stream; and an expander configured to, during ethane recovery, expand a vapor portion of a feed gas to the plant, and feed the expanded stream to the absorber.

In an embodiment, a method for operating a natural gas liquid plant in ethane recovery may comprise expanding a vapor portion of a feed gas to the plant to produce a chilled stream; feeding the chilled stream to an absorber; heating, by the exchanger, a vapor stream from the absorber; feeding the cooled ethane rich bottom stream to a stripper; and fractionating, by the stripper, the cooled ethane rich bottom stream into an ethane plus natural gas liquid stream and an overhead vapor stream.

In an embodiment, a method for operating an ethane rejection natural gas liquid plant in an ethane recovery mode may comprise fluidly coupling an expander to an absorber of the plant; expanding, by the expander, a vapor portion of a feed gas to the plant to produce a chilled stream; feeding the chilled stream to the absorber; fluidly coupling an exchanger to the absorber; cooling, by the exchanger, an ethane rich bottom stream from the absorber; heating, by the exchanger, a vapor stream from the absorber; feeding the cooled ethane rich bottom stream to a stripper; and producing, by the stripper, an ethane plus natural gas liquid stream.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
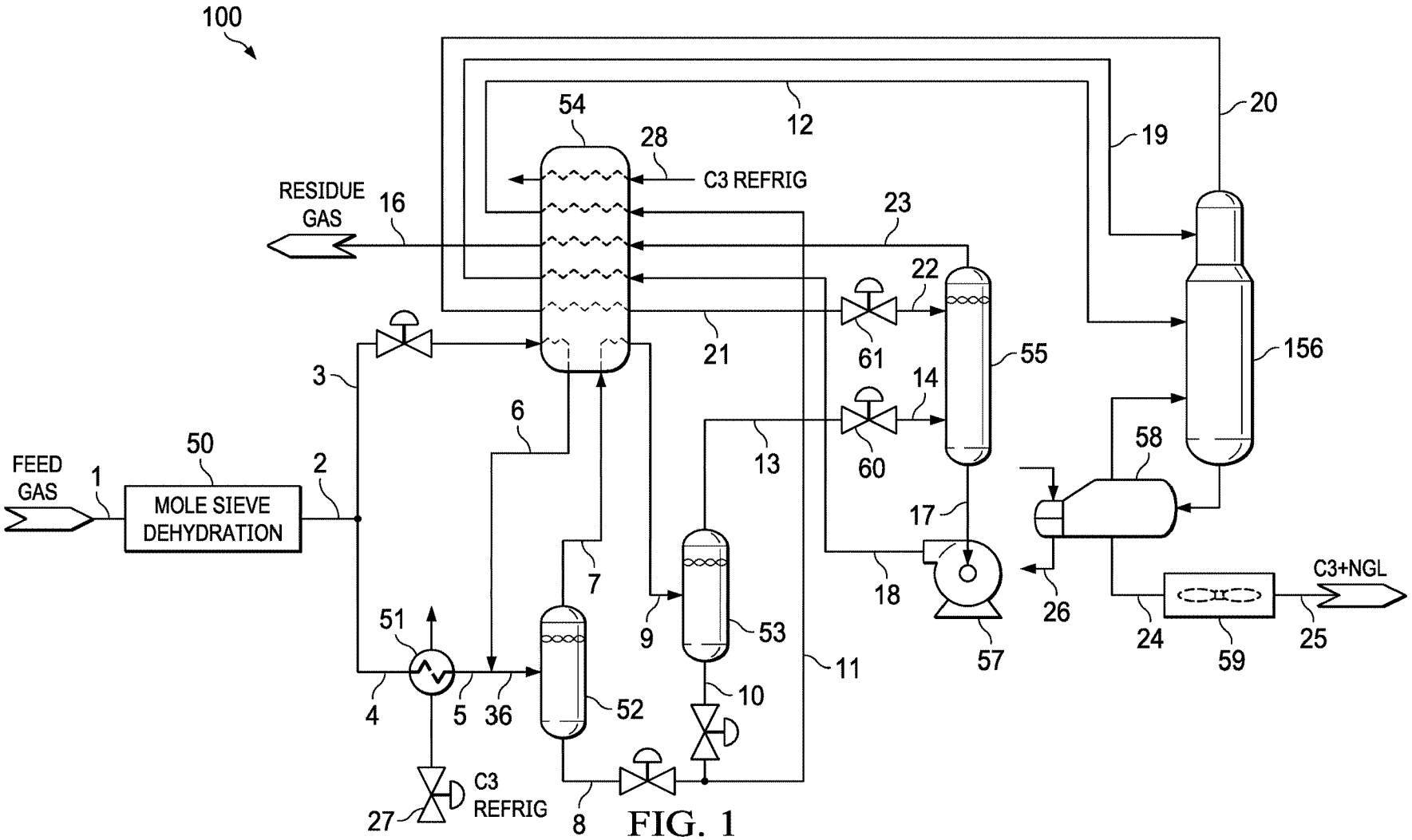
FIG. 1 is a schematic diagram of one exemplary NGL recovery method for ethane rejection according to the inventive subject matter.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

All references to percentages of flow refer to volumetric percentages unless otherwise indicated.

Most natural gas plants are designed to condition the feed gas to meet the pipeline sales gas specification, for example including heating value specification, hydrocarbon dew point, and water content. Typically, natural gas plants can be used to extract the propane plus components. However, when the feed gas contains a higher amount of ethane, extraction of propane may not be sufficient due to the high heating value of the feed gas, which is mainly due to the presence of ethane.

Typically, the main revenue from the gas plant operation is generated from sales of the condensate components, including propane, butanes, pentanes, and heavier hydrocarbons. Therefore, typical gas plants may be configured to maximize propane recovery. In the past, the ethane content in the feed gas was valued only for its heating content, and there were no significant incentives for ethane recovery. However, with increasing demand from petrochemical facilities to use ethane as a feedstock, ethane may be more valuable if recovered. Considering this market potential, many natural gas liquids (NGL) recovery plants may be designed for propane recovery with the provision (or option) of converting the propane recovery plant to high ethane recovery in the future.

Additionally, typical gas fields may contain excessive amount of ethane (13% and higher) such that a propane recovery plant would fail to meet the heating value requirement (1200 Btu/scf) of the sales gas, which would require propane recovery plants to operate in ethane recovery, resulting in lower propane recovery.

Numerous separation processes and configurations are known in the art to fractionate the NGL fractions from natural gas. In a typical gas separation process, a high pressure feed gas stream may be cooled by heat exchangers, using propane refrigeration and turbo expansion, and the extent of cooling may depend on the hydrocarbon contents and desired levels of recoveries. As the feed gas is cooled under pressure, the hydrocarbon liquids may be condensed and separated from the cooled gas. The cooled vapor is expanded and fractionated in distillation columns (e.g. a deethanizer and/or a demethanizer) to produce (1) a residue gas containing mainly methane gas to a sales gas pipeline and (2) an ethane plus bottom that is to be transported by pipeline to a distant petrochemical facility.

Typically, current natural gas plants process relatively lean gases with ethane content less than 10%. While typical gas plants may be acceptable for a feed gas with a lower ethane content, they may not be suitable if the ethane content feed gas is high.

Typical natural gas liquid plants may be configured for either high ethane recovery or high propane recovery, and typically the ethane recovery process will decrease propane recovery to below 90% if operated on ethane rejection. For example, Rambo et al. describe in U.S. Pat. No. 5,890,378 a system in which the absorber is refluxed, in which the deethanizer condenser provides refluxes for both the absorber and the deethanizer while the cooling duties are supplied by turbo-expansion and propane refrigeration. Here, the absorber and the deethanizer operate at essentially the same pressure. Although Rambo's configuration can recover 98% of the C3+ hydrocarbons during propane recovery operation, high ethane recovery (e.g. over 80%) is difficult even with additional refluxes. The other problem is to maintain high propane recovery (e.g. over 95%) when the NGL plant is required to operate under an ethane rejection mode. The rejected ethane will contain a significant amount of propane, which typically lowers the overall propane recovery to below 90%.

To circumvent at least some of the problems associated with low ethane recoveries, Sorensen describes in U.S. Pat. No. 5,953,935 a plant configuration in which an additional fractionation column and reflux condenser are added to increase ethane recovery using cooling with turbo expansion and Joule Thompson expansion valves of portions of the feed gas. Although Sorensen's configuration may achieve high ethane recoveries, it fails to achieve high propane recovery when operated on ethane rejection. In addition, the ethane plus NGL product must be re-fractionated in a deethanizer to meet the liquefied petroleum gas (LPG) vapor pressure specification, subsequently increasing the overall energy consumption.

In yet other known configurations, high NGL recoveries were attempted with various improved fractionation and reflux configurations. Typical examples are shown in U.S. Pat. Nos. 4,278,457, and 4,854,955, to Campbell et al., in U.S. Pat. No. 6,244,070 to Lee et al., and in U.S. Pat. No. 5,890,377 to Foglietta. While such configurations may provide at least some advantages over prior processes, they are generally intended to operate on a definite recovery mode, either ethane recovery or propane recovery. Moreover, most of such known configurations require extensive modifications of turbo expanders and piping routing when the plants are retrofitted from propane recovery to ethane recovery or vice versa. In most cases, the capital and operating cost for the retrofit processes are relatively high and the revenue losses due to facility shutdown for installation are also high, making the operational change uneconomical.

To circumvent at least some of the problems associated with high ethane recovery while maintaining a high propane recovery, a twin reflux process (described in U.S. Pat. No. 7,051,553 to Mak et al.) employs configurations in which a first column receives two reflux streams: one reflux stream comprising a vapor portion of the NGL and the other reflux stream comprising a lean reflux provided by the overhead of the second distillation column. Similarly, U.S. Pat. App. No. 2010/0206003 to Mak et al. describes an improved natural gas liquid recovery method in which residue gas is integrated to the propane recovery design such that it can be used to reflux the demethanizer during high ethane recovery. However, even with these improvements, high ethane recovery (over 90%) is typically not feasible with additional reflux streams. All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, although various configurations and methods are known to recover natural gas liquids, they typically suffer from one or more disadvantages. For example, while some known methods and configurations can be employed for ethane recovery and propane recovery, ethane rejection will typically result in a loss in propane recovery. Another drawback to the previously described systems is complexity of these systems, making them difficult to operate when changing ethane modes are required. Therefore, there is a need to provide methods and configurations for an NGL recovery plant that can recover high propane recovery of over 95% during ethane rejection, and can be modified to operate on ethane recovery of over 95% producing a pure ethane product for the petrochemical plants.

Embodiments of the disclosure relate to natural gas liquids plants as well as phase implementation of natural gas liquids plants from ethane rejection or high propane recovery to high ethane recovery. Systems and methods disclosed herein relate to processing natural gas, especially as it relates to the methods of configuring a natural gas liquid (NGL) plant for fully rejecting ethane and changing the configuration (e.g. retrofitting) of the NGL plant for over 95% ethane recovery, while maintaining high propane recovery.

The present invention is directed to methods and configurations of a phase implementation of a propane recovery plant (ethane rejection) to ethane recovery without (substantial) losses in propane recovery, where the plant may comprise an absorber and a stripper that are closely coupled with a feed gas/residue gas/refrigeration reflux system.

When the system is operating in ethane rejection, the contemplated methods and systems may produce an ethane rich sales gas and a propane plus NGL product stream, and during ethane recovery, the methods and systems may produce a lean gas to sales and a Y-grade NGL product stream to a downstream facility.

In some embodiments, a dried feed gas may be split into two portions at the inlet of the NGL plant battery limit, with a first portion at about 30% to 60% of the feed gas, where the first portion may be chilled and partially condensed and separated, forming a first liquid, while a vapor is further chilled to a lower temperature and separated, forming a second liquid, with the combined liquids let down in pressure and fed to the feed exchanger.

When the system is operating in ethane rejection, the stripper overhead may be partially condensed in the feed exchanger, forming a reflux that may be fed as reflux to the absorber. The feed exchanger may comprise at least six cores, which may include one or more of refrigerant liquid, separator liquids, absorber overhead, absorber bottom, fractionator overhead, and/or feed gas.

When the system is operating in ethane rejection, the stripper may fractionate the ethane rich NGL from the absorber into an ethane overhead product and a propane plus hydrocarbons product. The methods and systems described here may be configured to achieve over 95% propane recovery, while rejecting 98% of the ethane content from the NGL.

Also, when the system is operating in ethane recovery, a turbo expander and/or an absorber (bottom) exchanger may be added to the system to provide more chilling to the system, such that the NGL plants provide ethane recovery of at least 95% and propane plus recovery of at least 98%.

Disclosed embodiments of an NGL recovery plant may comprise an absorber and a stripper (which may function as a deethanizer/demethanizer) fluidly coupled, and the plant may be changed from ethane rejection to ethane recovery or vice versa with minor process adjustment. The same equipment and piping can be used for both operations and no retrofit may be required to meet the minimum 95% ethane and high propane recovery (for example, if the plant is built to this embodiment configuration, where pre-existing plants may also be retrofit towards this embodiment configuration).

It should be recognized that the disclosed plant may be used to condition the feed gas to meet the sales gas heating value specification and ethane recovery targets in ethane recovery operation.

The feed gas to the system can be a variable feed gas with variable hydrocarbons content and ethane content and is supplied at a temperature of about 100° F. and a pressure of about 900 psig. As used herein, the term "about" in conjunction with a numeral refers to that numeral +/−10, inclusive. For example, where a temperature is "about 100° F.", a temperature range of 90-110° F., inclusive, is contemplated.

Referring now to FIG. 1, an exemplary NGL plant 100 may comprise two columns, such as an absorber 55 and a stripper 156, where one column (e.g. the stripper 156) may serve as a deethanizer 156 during ethane rejection and as a demethanizer 256 (described in FIG. 2) during ethane recovery.

In one exemplary configuration as depicted in FIG. 1, an NGL recovery plant 100 may comprise a first column (absorber) 55 that is fluidly coupled to a second column (deethanizer) 156. The plant 100 as shown in FIG. 1 may operate in "ethane rejection" as described above. As an example, the feed gas stream 1 may be dried in molecular sieve unit 50, forming a dried gas stream 2, which may enter the plant battery limit. The dried gas stream 2 may be split into two portions, stream 3 and stream 4, in a ratio of about 30 to 60% of the feed gas flow. The ratio may be dependent on the richness of the feed gas, and the ratio may be increased to provide more flow to a propane chiller 51 when the richness of the feed gas increases. Stream 3 may be chilled in a feed exchanger 54, forming stream 6, while stream 4 may be chilled in the propane chiller 51 using a refrigerant stream 27, forming stream 5, where stream 5 may be mixed with stream 6, forming combined stream 36. The feed exchanger 54 may be operated using a refrigerant stream 28.

Stream 36 may be separated in a separator 52 into a vapor stream 7 and a liquid stream 8. Vapor stream 7 may be further chilled in the feed exchanger 54, forming stream 9, which may then be separated in a separator 53 into vapor stream 13 and liquid stream 10. Liquid stream 10 may be letdown in pressure and combined with the letdown liquid stream 8, forming a further chilled stream 11, where stream 11 may be fed to the feed exchanger 54 to be heated, forming stream 12. Stream 12 may be fed to the mid-section of the deethanizer 156. The recovery of the refrigeration from the letdown stream enhances the operating efficiency of the process.

Stream 13 may be letdown in pressure in JT valve 60 forming stream 14, where stream 14 may be fed to the absorber 55. Absorber 55 may produce an ethane rich bottom liquid stream 17 and a propane depleted vapor stream 23. The propane depleted vapor stream 23 may be heated in the feed exchanger 54 to produce residue gas stream 16. Bottom liquid stream 17 may be pumped by pump 57, forming stream 18, which may be about 100 psi higher than the absorber pressure. Stream 18 may be chilled in feed exchanger 54, forming stream 19 which may be fed as reflux to the deethanizer 156.

During the ethane rejection operation (as shown in FIG. 1), the second column acts as a deethanizer 156 and may operate at a higher pressure than the absorber 55, fractionating the absorber bottom (stream 19) and the separator liquid (stream 12) into a propane plus NGL stream 24 and an overhead vapor stream 20. The overhead vapor stream 20 may be chilled in the feed exchanger 54 forming chilled stripper vapor stream 21. The chilled stripper vapor stream 21 may be letdown in pressure via a JT valve 61 and chilled, forming stream 22, which may be fed to the absorber 55 as reflux. A heat medium stream 26 (for example, hot oil or steam) may be used to supply the bottom duty to exchanger 58, maintaining the ethane content in the propane plus NGL stream 24 to below 1 to 2 volume %. The stripper bottom propane plus NGL stream 24 may be further cooled in air cooler 59, forming stream 25 as the NGL product.

As an example of suitable conditions of the process shown in FIG. 1, Stream 3 may be chilled in the feed exchanger 54 to about 0° F., forming stream 6. Vapor stream 7 may be chilled in the feed exchanger 54, forming stream 9 at about −40° F. Liquid stream 10 may be combined with liquid stream 8, forming stream 11 operating at −55° F., where stream 11 may be fed to the feed exchanger 54 to be heated to about 0° F., forming stream 12. Stream 13 may be letdown in pressure in JT valve 60 to about 300 psia and chilled to about −60° F., forming stream 14, where stream 14 may be fed to the absorber 55. Absorber 55 may produce an ethane rich bottom liquid stream 17, at about −75° F. Stream 18 may be chilled in feed exchanger 54 to about −40° F., forming stream 19. The chilled stripper vapor stream 21 may be letdown in pressure via a JT valve 61 and chilled to about −75° F., forming stream 22. During the ethane rejection operation (as shown in FIG. 1), the second column (or deethanizer) 156 may operate at about 50 to 100 psi higher pressure than the absorber 55.

Figure 3:
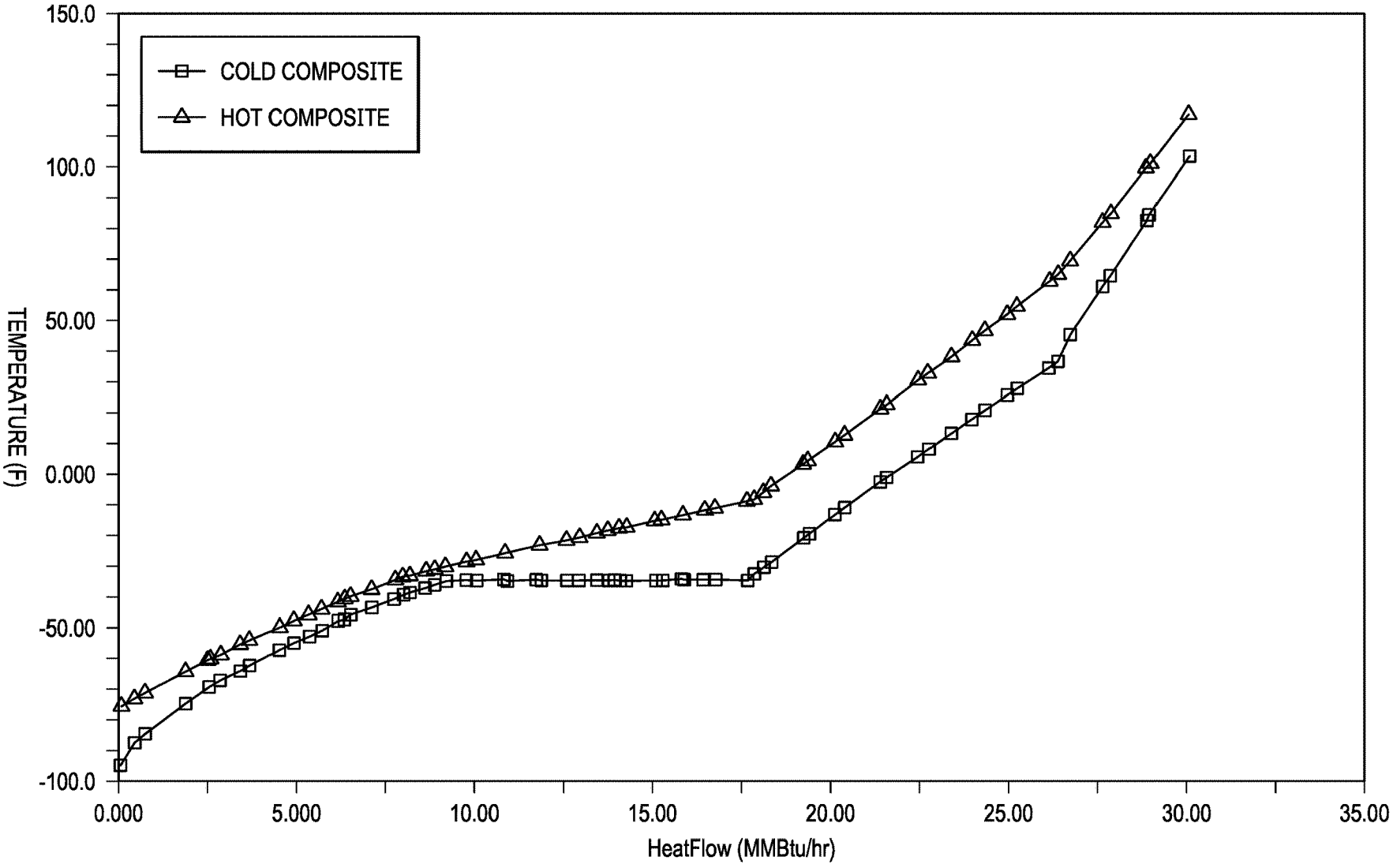
FIG. 3 is a heat recovery curve composite diagram for ethane rejection according to the inventive subject matter.

The heat recovery efficiency of the ethane rejection process (described above in FIG. 1) is shown in heat composite curve in FIG. 3, and the overall heat and material balance table is shown below in Table 1.

TABLE 1

Heat and material balance for ethane rejection

| Description<br>Component | Dry Gas<br>Mole % | C3 + NGL<br>Mole % | Sale Gas<br>Mole % |
|---|---|---|---|
| Nitrogen | 1.22 | 0.00 | 1.39 |
| CO2 | 0.00 | 0.00 | 0.00 |
| Methane | 73.83 | 0.00 | 83.90 |
| Ethane | 13.22 | 3.26 | 14.58 |
| Propane | 8.25 | 67.81 | 0.13 |
| i-Butane | 0.68 | 5.67 | 0.00 |
| n-Butane | 2.10 | 17.51 | 0.00 |
| i-Pentane | 0.27 | 2.25 | 0.00 |
| n-Pentane | 0.32 | 2.67 | 0.00 |
| Hexane+ | 0.10 | 0.83 | 0.00 |
| H2S | 0.00 | 0.00 | 0.00 |
| H2O | 0.00 | 0.00 | 0.00 |
| Total | 100.00 | 100.00 | 100.00 |
| Molar Flow (lb mole/h) | 6,588.3 | 790.3 | 5,798.1 |
| Temperature (° F.) | 118.0 | 110.0 | 104.0 |
| Pressure (psia) | 915.0 | 368.0 | 295.0 |

Figure 2:
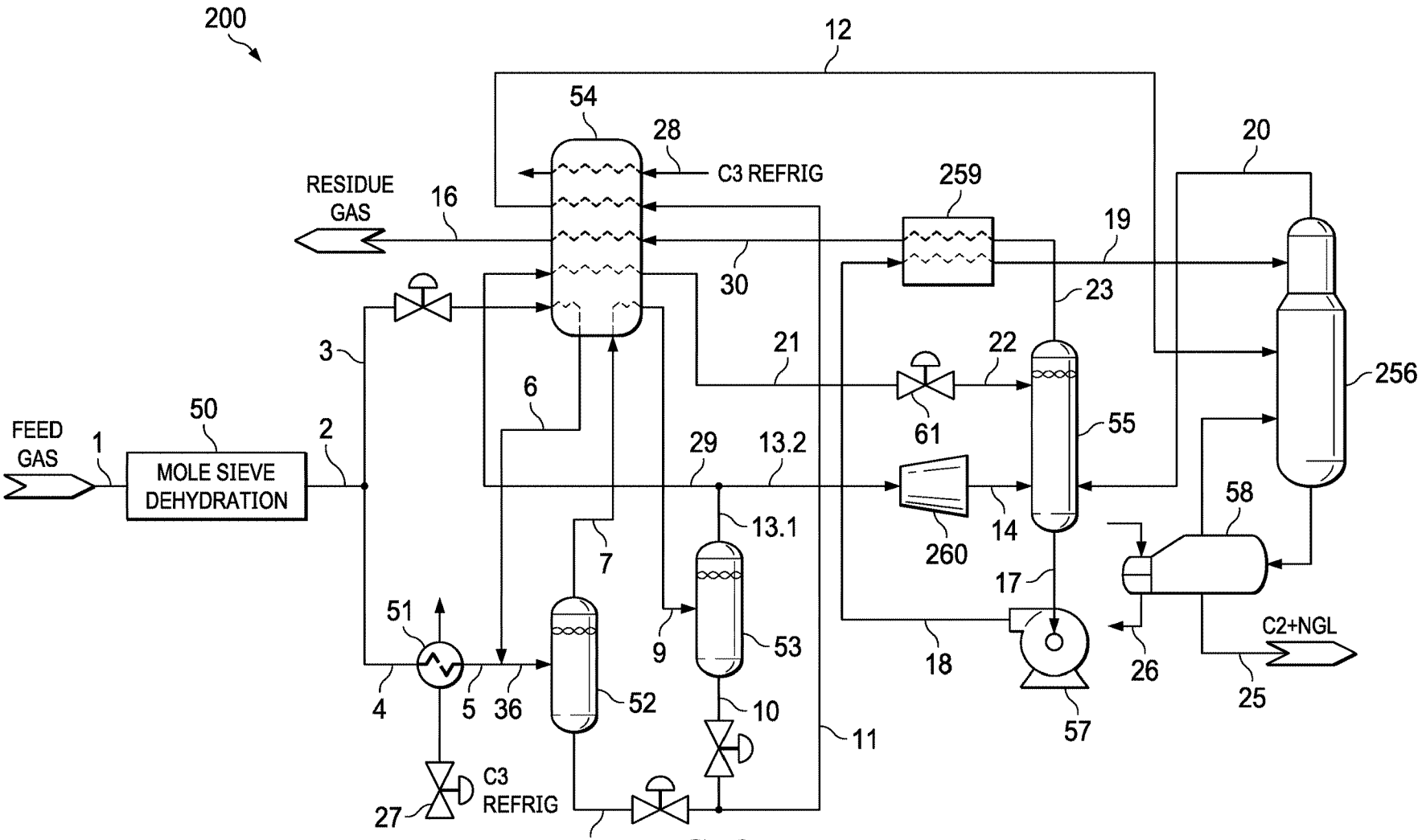
FIG. 2 is a schematic diagram of another exemplary NGL recovery method for ethane recovery according to the inventive subject matter.

In another exemplary embodiment, as depicted in FIG. 2, an NGL recovery plant 200 can operate in ethane recovery mode, capable of (at least) 95% ethane recovery and higher while maintaining high propane recovery (e.g. 99% or at least 95%). During this operation, the stripper (or second column) may operate as a demethanizer 256 (instead of acting as a deethanizer, as in FIG. 1) producing the ethane plus NGL (stream 25). The plant 200 may be similar to the plant 100 as described in FIG. 1, with minor changes in piping routing, and possibly with some elements operating at a lower temperature profile, where only the new parts of the plant 200 are described below. The remaining portions of the plant of FIG. 2 can be the same as or similar to those described with respect to the elements shown in FIG. 1, and the description of those elements is hereby repeated.

The additional equipment required for the ethane recovery operation (shown in FIG. 2) may include an expander 260 and/or an exchanger 259 (with FIG. 2 showing an embodiment/configuration with both). The expander 260 may provide a refrigeration stream 14 to the absorber 55, allowing the system to operate at a lower temperature, and the exchanger 259 may (optionally) allow the absorber bottom liquid (stream 17) to the demethanizer 256 to operate at a lower temperature (for example, at about −120 to −130° F.). With the expander operating, the outlet stream 14 may drop in temperature to about −120° F. and may be at a similar pressure to the stream 14 described above in FIG. 1 (i.e. about 300 psia). Preferably, in ethane recovery operation (shown in FIG. 2), the plant would have both the expander 260 and the exchanger 259. The use of the exchanger 259 in combination with the expander 260 may allow the plant to effectively process a range of feed stream compositions.

The front section of the ethane recovery process may be the same as the ethane rejection case (as described in FIG. 1). The feed stream 13.2 to the expander 260 may come from the vapor stream 13.1 of the separator 53, wherein stream 13.1 may be split into stream 13.2 (to the expander) and stream 29 (to the feed exchanger 54). Stream 13.2 may be controlled to about 40 to 60% of the feed gas stream 1 (by flow rate) and may be chilled to about −115° F. The remaining flow, stream 29, may be routed to and chilled by the feed exchanger 54, supplying the reflux stream 22 to the absorber 55 (as described above in FIG. 1). With these changes, the absorber 55 can operate at lower temperatures, producing an absorber overhead ethane depleted vapor stream 23 (which may be similar to the propane depleted vapor stream 23 described in FIG. 1, but with at least a portion of the ethane removed from the stream 23) at about −155° F. and a bottom liquid stream 17 at about −120° F.

During operation of the plant 200 for ethane recovery, the demethanizer 256 is configured to fractionate the absorber bottom stream 19 into an ethane plus NGL stream 25 and an overhead vapor stream 20. The overhead vapor stream 20 may be fed to the bottom of the absorber 55 for reabsorption of the ethane content (as opposed to being heated and returned to the absorber 55 as reflux, as in FIG. 1). The ethane plus NGL stream 25 may contain about 1 mole % methane content, meeting the required specification for Y-grade NGL.

As described above, the absorber 55 may produce an ethane rich bottom liquid stream 17 and an ethane depleted vapor stream 23. The bottom liquid stream 17 may be pumped by pump 57, forming stream 18, which may be about 10 to 20 psi higher than the absorber pressure, as needed to feed the demethanizer 256 downstream. To further improve ethane recovery, stream 18 may be fed to the exchanger 259 and chilled to form stream 19, which is then fed to the demethanizer 256. The vapor stream 23 from the absorber 55 may also be fed to the exchanger 259 and heated to form stream 30, which is then further heated in the feed exchanger 54, producing the residue gas stream 16. Alternatively, the absorber bottom stream 18 can be fed directly to the demethanizer 256 (however ethane recovery may not be as effective with this configuration, i.e. ethane recovery may be reduced by about 1 to 2%).

Figure 4:
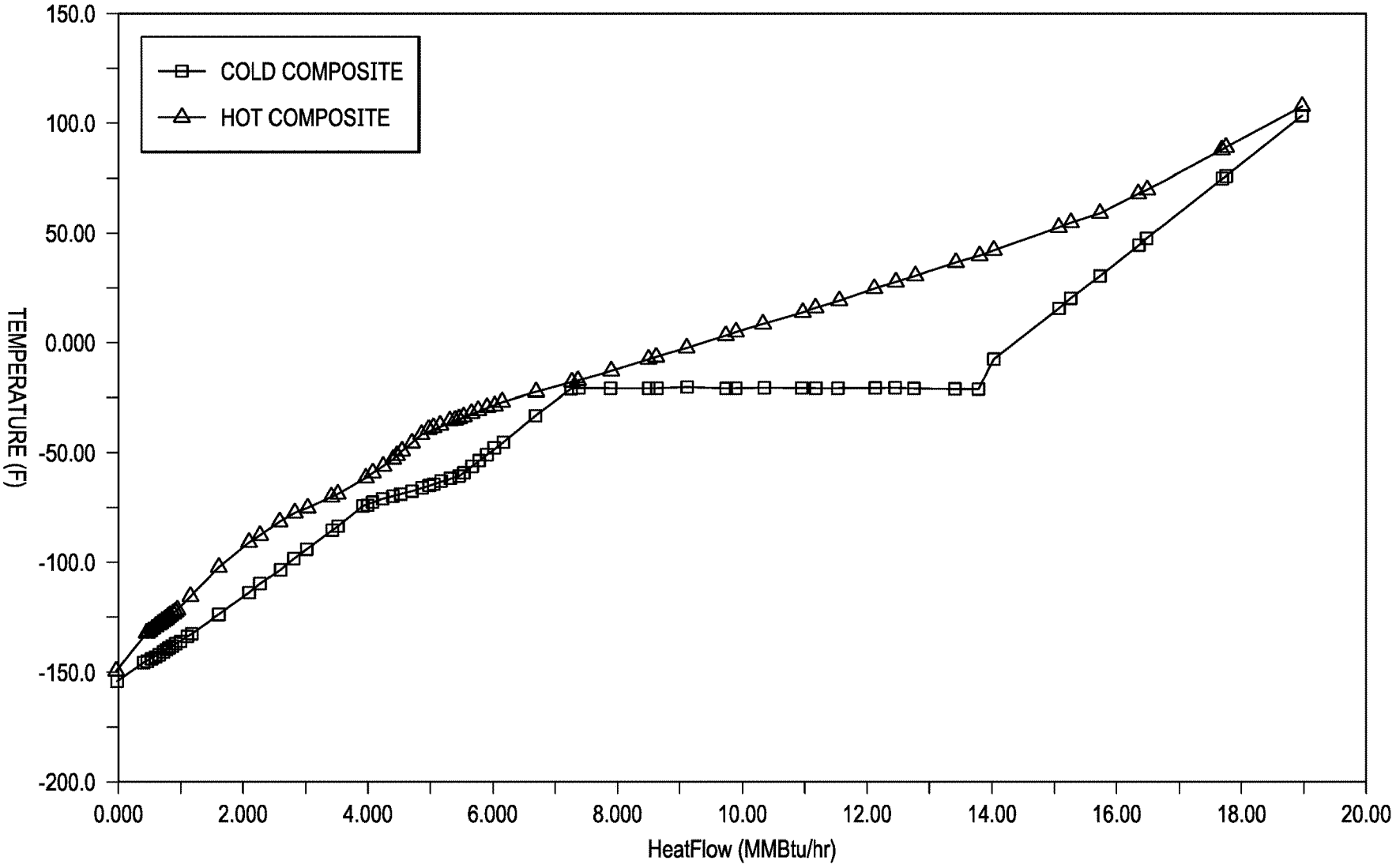
FIG. 4 is a heat recovery curve composite diagram for ethane recovery according to the inventive subject matter.

The heat recovery efficiency of the ethane recovery process is shown in heat composite curve in FIG. 4, and the overall heat and material balance table is shown below in Table 2.

TABLE 2

Heat and material balance for ethane recovery

| Description<br>Component | Dry Gas<br>Mole % | C2 + NGL<br>Mole % | Sale Gas<br>Mole % |
|---|---|---|---|
| Nitrogen | 1.22 | 0.00 | 1.66 |
| CO2 | 0.00 | 0.00 | 0.00 |
| Methane | 73.83 | 1.17 | 97.60 |
| Ethane | 13.22 | 49.72 | 0.70 |
| Propane | 8.25 | 35.72 | 0.03 |
| i-Butane | 0.68 | 3.00 | 0.00 |
| n-Butane | 2.10 | 7.95 | 0.00 |
| i-Pentane | 0.27 | 0.90 | 0.00 |
| n-Pentane | 0.32 | 0.97 | 0.00 |
| Hexane+ | 0.10 | 0.53 | 0.00 |
| H2S | 0.00 | 0.00 | 0.00 |
| H2O | 0.00 | 0.00 | 0.00 |
| Total | 100.00 | 100.00 | 100.00 |
| Molar Flow (lb mole/h) | 6588.3 | 1544.2 | 5043.5 |
| Temperature (° F.) | 118.0 | 67.7 | 104.0 |
| Pressure (psia) | 915.0 | 305.0 | 302.0 |

With respect to suitable feed gas streams, it is contemplated that different feed gas streams are acceptable, and especially feed gas streams may contain a high level of ethane and heavier hydrocarbon content. With respect to the gas compositions, it is generally preferred that the feed gas stream predominantly includes C1-C6 hydrocarbons and nitrogen and other inert compounds (but may exclude $CO_2$ due to potential freeze issues). The contemplated preferred feed gas streams are associated and non-associated gas from oil and gas production units.

Thus, specific embodiments and applications for improved natural gas liquids recovery have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

Having described various devices and methods herein, exemplary embodiments or aspects can include, but are not limited to:

In a first embodiment, a natural gas liquid plant configured to operate in either ethane rejection or ethane recovery may comprise an absorber configured to produce an ethane rich bottom stream and a propane depleted vapor stream; a stripper fluidly coupled to the absorber configured to, during ethane rejection, fractionate the ethane rich bottom stream from the absorber into an ethane overhead product and a propane plus hydrocarbons product, and configured to, during ethane recovery, fractionate the ethane rich bottom stream into an ethane plus NGL stream and an overhead vapor stream; and an expander configured to, during ethane recovery, expand a vapor portion of a feed gas to the plant, and feed the expanded stream to the absorber.

A second embodiment can include the plant of the first embodiment, further comprising an exchanger configured to, during ethane recovery, counter-currently contact the ethane rich bottom stream from the absorber with the ethane depleted vapor stream from the absorber, thereby heating the vapor stream and chilling the ethane rich bottom stream before the ethane rich bottom stream is fed to the stripper.

A third embodiment can include the plant of the first or second embodiments, wherein the expanded vapor stream from the expander to the absorber provide increased chilling to the absorber when compared with the plant during ethane rejection.

A fourth embodiment can include the plant of any of the first to third embodiments, wherein the chilled ethane rich bottom stream that is fed to the stripper provides increased chilling to the stripper when compared with the plant during ethane rejection.

A fifth embodiment can include the plant of any of the first to fourth embodiments, wherein, during ethane recovery, the overhead vapor stream from the stripper is fed to the bottom of the absorber for reabsorption of the ethane content.

A sixth embodiment can include the plant of any of the first to fifth embodiments, wherein, during ethane recovery, the ethane plus natural gas liquids stream (from the stripper) contains about 1 mole % methane content.

A seventh embodiment can include the plant of the sixth embodiment, wherein during ethane rejection, the stripper functions as a deethanizer.

An eighth embodiment can include the plant of any of the first to seventh embodiments, wherein during ethane recovery, the stripper functions as a demethanizer.

A ninth embodiment can include the plant of any of the first to eighth embodiments, wherein the plant produces at least 95% (or at least about 95%) propane recovery during ethane rejection.

A tenth embodiment can include the plant of any of the first to ninth embodiments, wherein the plant produces at least 95% (or 99%, at least 99%, or about 99%) propane recovery during ethane recovery.

In an eleventh embodiment, a method for operating a natural gas liquid plant in ethane recovery may comprise expanding a vapor portion of a feed gas to the plant to produce a chilled stream; feeding the chilled stream to the absorber; heating, by the exchanger, a vapor stream from the absorber; feeding the cooled ethane rich bottom stream to a stripper; and fractionating, by the stripper, the cooled ethane rich bottom stream into an ethane plus natural gas liquid stream and an overhead vapor stream.

A twelfth embodiment can include the method of the eleventh embodiment, further comprising cooling, by an exchanger, a bottom stream from an absorber, wherein the bottom stream comprises an ethane rich bottom stream.

A thirteenth embodiment can include the method of the eleventh or twelfth embodiments, wherein, during ethane recovery, the absorber operates at a lower temperature than when the plant is operated in ethane rejection.

A fourteenth embodiment can include the method of any of the eleventh to thirteenth embodiments, wherein, during ethane recovery, the ethane plus natural gas liquids stream (from the stripper) contains about 1 mole % methane content.

A fifteenth embodiment can include the method of any of the eleventh to fourteenth embodiments, further comprising feeding the overhead vapor stream from the stripper to the bottom of the absorber for reabsorption of the ethane content.

In a sixteenth embodiment, a method for operating an ethane rejection natural gas liquid plant in an ethane recovery mode may comprise fluidly coupling an expander to an absorber of the plant; expanding, by the expander, a vapor portion of a feed gas to the plant to produce a chilled stream; feeding the chilled stream to the absorber; fluidly coupling an exchanger to the absorber; cooling, by the exchanger, an ethane rich bottom stream from the absorber; heating, by the exchanger, a vapor stream from the absorber; feeding the cooled ethane rich bottom stream to a stripper; and producing, by the stripper, an ethane plus natural gas liquid stream.

A seventeenth embodiment can include the method of the sixteenth embodiment, wherein, during ethane recovery, the absorber operates at a lower temperature than during ethane rejection.

An eighteenth embodiment can include the method of the sixteenth or seventeenth embodiments, further comprising producing, by the stripper, an overhead vapor stream, and feeding the overhead vapor stream from the stripper to the bottom of the absorber for reabsorption of the ethane content.

A nineteenth embodiment can include the method of any of the sixteenth to eighteenth embodiments, wherein, during ethane recovery, the ethane plus natural gas liquids stream (from the stripper) contains about 1 mole % methane content.

A twentieth embodiment can include the method of any of the sixteenth to nineteenth embodiments, wherein the plant produces at least 95% propane recovery during ethane recovery.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method for operating a natural gas liquid plant in ethane recovery, the method comprising:

separating a chilled feed gas into a vapor stream and a liquid stream;

separating the vapor stream into a vapor portion and a liquid portion, splitting the vapor portion into a first portion and a second portion;

expanding, by an expander, the first portion to produce a refrigeration stream;

cooling, in a first heat exchanger, and letting down a pressure of, in a valve, the second portion to produce a reflux stream;

feeding the refrigeration stream and the reflux stream to an absorber;

producing, by the absorber, an absorber overhead stream and an absorber bottom stream;

heating, in a second heat exchanger, the absorber overhead stream;

cooling the absorber bottom stream in the second heat exchanger to produce a cooled ethane rich bottom stream;

feeding the cooled ethane rich bottom stream from the absorber to a stripper;

fractionating, by the stripper, the cooled ethane rich bottom stream into a natural gas liquid stream and a stripper overhead stream;

combining the liquid stream and the liquid portion to form a second liquid stream; and feeding the second liquid stream to the stripper; and heating the second liquid stream in the first heat exchanger before feeding the second liquid stream to the stripper.

2. The method of claim 1, the absorber bottom stream has a lower temperature than when the plant is operated in ethane rejection.

3. The method of claim 1, the natural gas liquid stream contains about 1 mole % methane content.

4. The method of claim 1, further comprising feeding the stripper overhead stream from the stripper to a bottom of the absorber.

5. The method of claim 1, wherein the second liquid stream is fed to a mid-section of the stripper.

6. The method of claim 1, further comprising:

splitting a feed gas into a first stream and a second stream;

chilling the first stream in the first heat exchanger;

chilling the second stream in a propane chiller; and combining the chilled first stream and the chilled second stream to form the chilled feed gas.

7. The method of claim 6, wherein the feed gas is dried prior to the step of splitting the feed gas.

8. The method of claim 6, wherein a flow rate of the first portion is about 40 to 60% of a flow rate of the feed gas.

9. The method of claim 1, wherein the cooled ethane rich bottom stream is fed to a top of the stripper.

10. The method of claim 1, further comprising:

heating, in the first heat exchanger, the absorber overhead stream to produce a residue gas stream.

11. The method of claim 1, having an ethane recovery of at least 95% and a propane recovery of at least 95%.

12. The method of claim 1, wherein the stripper is a demethanizer.

13. The method of claim 1, wherein the first portion has a temperature of about −115° F.

14. The method of claim 1, wherein the refrigeration stream has a temperature of about −120° F. and a pressure of about 300 psia.

15. The method of claim 1, wherein the valve is a JT valve.

* * * * *